US006540125B1

(12) United States Patent
De Jongh

(10) Patent No.: US 6,540,125 B1
(45) Date of Patent: Apr. 1, 2003

(54) DEVICE FOR CLAMPING AND BREAKING A PHIAL

(75) Inventor: Hermanus Hendrik De Jongh, Doesburg (NL)

(73) Assignee: International Medical Products B.V., Zutphen (NL)

( * ) Notice: Subject to any disclaimer, the term of this patent is extended or adjusted under 35 U.S.C. 154(b) by 0 days.

(21) Appl. No.: 09/647,039

(22) PCT Filed: Mar. 25, 1999

(86) PCT No.: PCT/NL99/00171

§ 371 (c)(1),
(2), (4) Date: Jan. 29, 2001

(87) PCT Pub. No.: WO99/48800

PCT Pub. Date: Sep. 30, 1999

(30) Foreign Application Priority Data

Mar. 25, 1998 (NL) ..... 1008699

(51) Int. Cl.[7] ..... B25B 27/00; B26F 3/04
(52) U.S. Cl. ..... 225/93; 225/105
(58) Field of Search ..... 229/93, 94, 96, 229/96.5, 105; 241/99; D24/127, 131

(56) References Cited

U.S. PATENT DOCUMENTS

| | | | | | |
|---|---|---|---|---|---|
| 2,659,253 | A | | 11/1953 | Myrick | 225/93 |
| 2,865,524 | A | | 12/1958 | Reznek | 215/6 |
| 2,977,014 | A | * | 3/1961 | Kock | 215/13.1 |
| 3,450,319 | A | | 6/1969 | Ray et al. | 225/104 |
| 3,544,020 | A | * | 12/1970 | Goldberg et al. | 215/12.1 |
| 3,720,250 | A | * | 3/1973 | Goldberg et al. | 81/3.4 |
| 3,999,451 | A | * | 12/1976 | Ogle | 225/93 |
| 4,226,376 | A | * | 10/1980 | Pfleger | 225/93 X |
| 4,405,069 | A | * | 9/1983 | Vivier et al. | 225/93 |
| 4,506,817 | A | * | 3/1985 | Parker | 225/96.5 |
| 4,637,139 | A | * | 1/1987 | Chen | 241/99 X |
| 4,659,024 | A | * | 4/1987 | Frunzi et al. | 241/99 |
| 5,129,566 | A | * | 7/1992 | Ogden et al. | 225/93 |
| 5,423,440 | A | | 6/1995 | Castaneda et al. | 215/49 |

FOREIGN PATENT DOCUMENTS

| | | |
|---|---|---|
| EP | 0440354 | 8/1991 |
| GB | 2081692 | 2/1982 |

* cited by examiner

*Primary Examiner*—Charles Goodman
(74) *Attorney, Agent, or Firm*—Webb Ziesenheim Logsdon Orkin & Hanson, P.C.

(57) ABSTRACT

A device for clamping a breakable article, in particular a phial, provided with a breaking zone dividing said article into two parts, comprising means for clamping one part and means pivotably attached to said clamping means for holding the second part of said article in order to allow safe breaking.

8 Claims, 3 Drawing Sheets

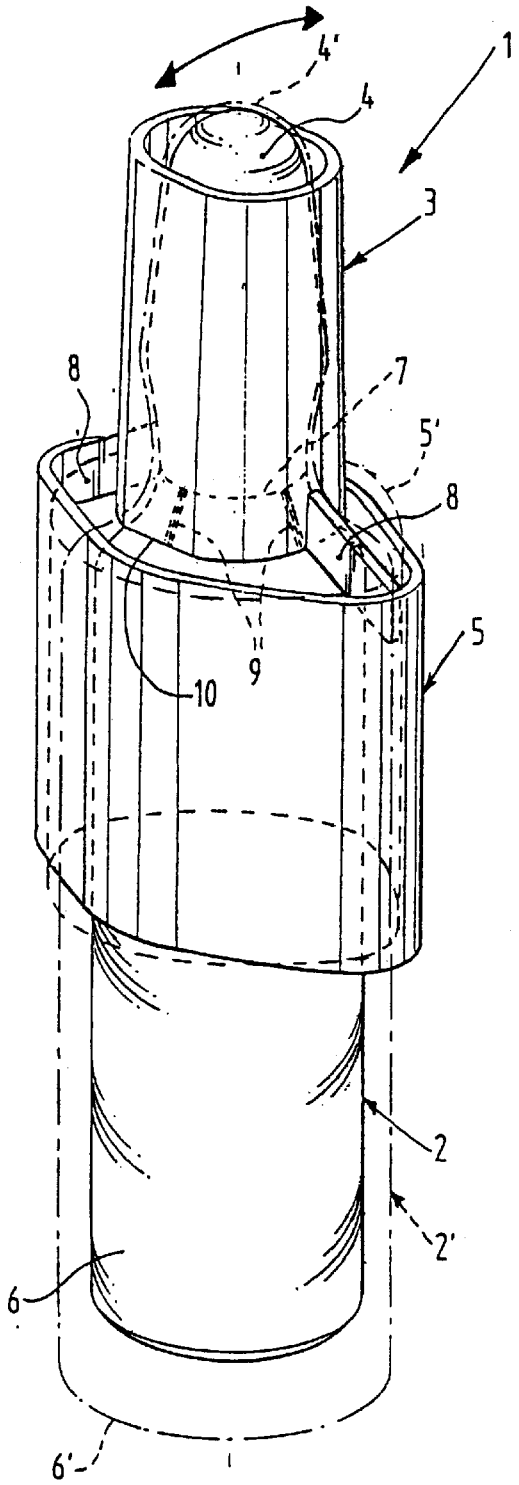
FIG. 1A
FIG. 1B
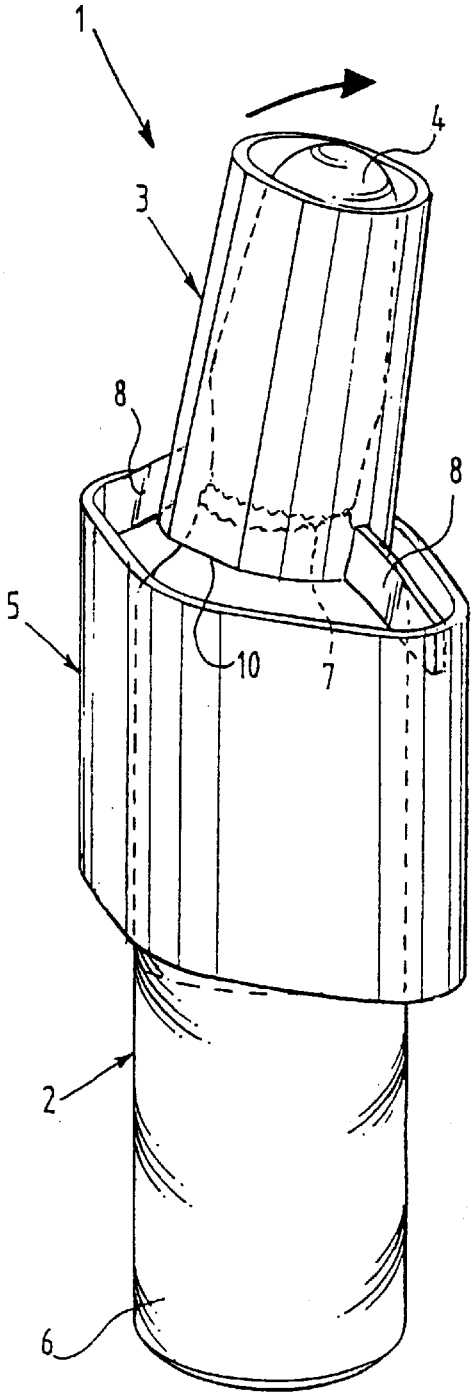

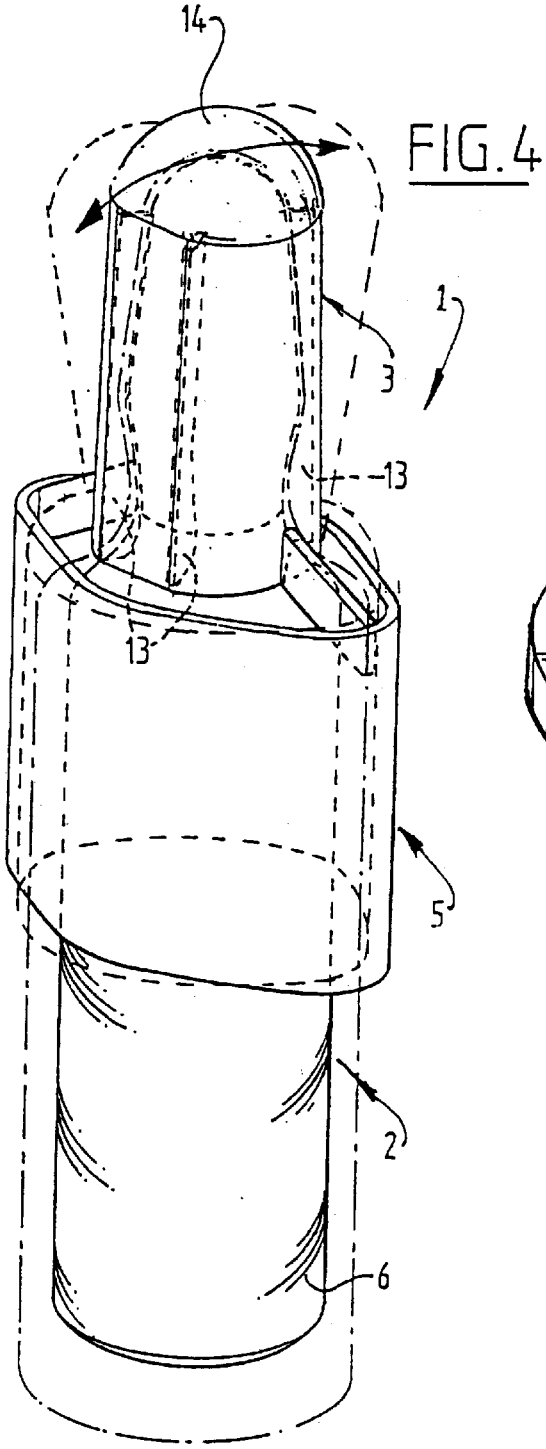
FIG.4
FIG.3
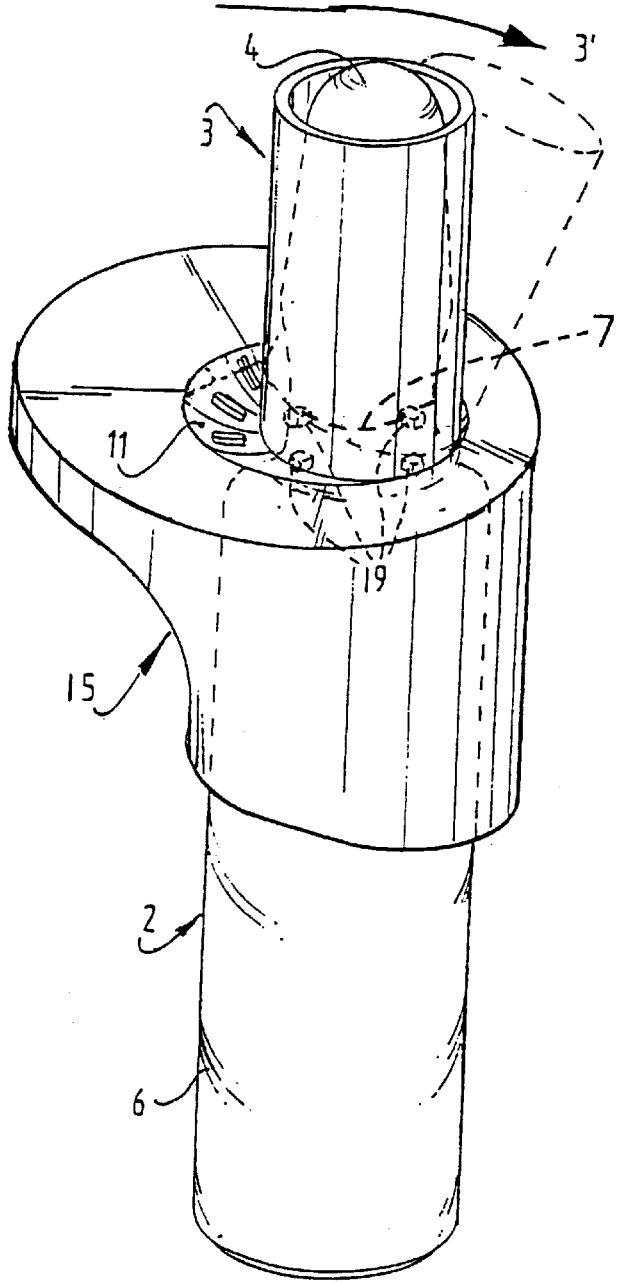

DEVICE FOR CLAMPING AND BREAKING A PHIAL

BACKGROUND OF THE INVENTION

The invention relates to a device for clamping a breakable object, in particular an ampule, provided with means for engaging the object on one side of a possible breaking point. Such a device is known and is for instance marketed under the name "NAFA Ampule Breaker" by "De Nederlandse Ampullenfabriek B.V" in Nijmegen.

The known ampule breaker consists of a tubular plastic member, which is open on one side and provided along its inner wall with somewhat resilient ribs. The open side is likewise provided with resilient protrusions or flaps extending over a part of the opening. This tubular member is intended to be pushed close-fittingly over a top or head of a breaking ampule for opening. Such a breaking ampule, which is generally manufactured from glass, consists of a body in which liquid is arranged and a head connected thereto via a narrowed neck. The narrowed neck herein forms the intended breaking point of the ampule.

As a result of the presence of the resilient ribs and flaps, the neck and the head of such an ampule are clamped into the tubular member, whereafter the body of the ampule can be gripped and can be bent relative to the neck and head clamped in the tubular member until the neck breaks, whereby the ampule is opened. Because the neck and head of the ampule are clamped in the tubular member during breaking thereof, they have some protection. A relatively great force can thus be exerted thereon without the risk of the head in particular being squeezed into pieces and the user being injured by glass splinters. The broken-off head is moreover held fast in the tubular member, so that it can be easily discarded without forming a hazard in the waste flow.

The known device has the drawback that the body of the ampule is not protected when the neck is broken off and must be held with the hand. There is hereby the danger that at the moment the neck collapses the user unintentionally comes into contact with the sharp breaking edge, which can result in injury to the user. Collapse of the neck of the ampule moreover often results in a shock reaction and involuntary movement, which may result in leakage of a part of the content of the ampule.

SUMMARY OF THE INVENTION

The invention now has for its object to improve an ampule breaker of the above described type such that the above stated drawback does not occur. This is achieved according to the invention by providing the clamping device with means for holding a part of the object lying on the other side of the breaking point. By thus also clamping the body of the ampule the user is prevented from coming into contact with the breaking edge when the neck collapses. In addition, collapse takes place in very controlled manner with this device because the breaking force can be well distributed. There is therefore no danger of uncontrolled shock movements and spillage of a part of the content of the ampule possibly resulting therefrom.

BRIEF DESCRIPTION OF THE DRAWINGS

The invention is now described on the basis of a number of embodiments wherein reference is made to the annexed drawing, in which:

FIGS. 1A and 1B are perspective views of a first embodiment of the clamping device according to the invention with different ampule sizes, both before and during use, FIG. 3 is a perspective view of an alternative embodiment of the clamping device, and, FIG. 4 shows a view corresponding with FIG. 1 of a closed variant of the clamping device shown therein.

DETAILED DESCRIPTION OF THE PREFERRED EMBODIMENTS

Figure 2A:
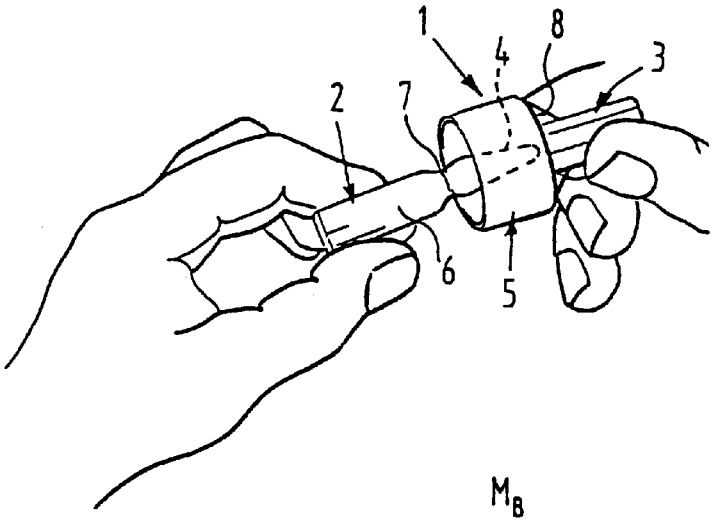
FIGS. 2A–D show the different steps of breaking open an ampule with the device of FIG. 1.

A device 1 for clamping an ampule 2 is provided with means 3 for engaging a head 4 of the ampule and means 5 for holding a body 6 of the ampule. Head 4 and body 6 of ampule 2 are herein connected by a neck 7 which forms the intended breaking point.

Holding means 5 and engaging means 3, which are formed integrally, are movable relative to one another. For this purpose both parts, each formed by a sleeve, are mutually connected by two relatively flat hinge members or wings 8 placed radially opposite each other. These hinge members 8 are relatively flexible transversely of their plane but relatively rigid in their plane, so that on the one hand a firm connection is formed between the two sleeves 3, 5 but on the other a good hinge action to two sides results.

The narrow sleeve forming part of engaging means 3 is otherwise also provided in the end 10 thereof meeting the wider sleeve 5 with a number of radially inward protruding pins 9 distributed in peripheral direction for holding therein head 4 of ampule 2 which will have a slightly larger diameter than the neck 7 thereof. Instead of pins 9, ribs 13 could also be applied which could extend over a part or the entire length of narrow sleeve 3 (FIG. 4). In addition, this narrow sleeve 3 could be closed on its side remote from wide sleeve 5 by a head 14, whereby head 4 of ampule 2 is prevented after breaking off thereof from being released from clamping device 1.

The wider sleeve 5 takes an elliptic form in order to enable simple adaptation to different dimensions of the body 6 of the diverse commercially available ampules. Owing to the elliptic shape of this part of clamping device 1 and to the fact that the clamping device is manufactured from a somewhat resiliently deformable material, for instance an injection moulded material such as polypropylene, the sleeve 5, by bending slightly outward in the centre (broken line position 5' in FIG. 1), can also accommodate ampules 2' (shown with dash-dot lines) with a body 6' having a diameter greater than the width of device 1. Because hinge members 8 are herein placed in the longitudinal direction of the elliptic shape and are therefore flexible in transverse direction of the elliptic shape, ampule 2 is loaded during use of device 1 in the direction in which the clamping force acting thereon is the greatest.

In an alternative embodiment of clamping device 1 the hinge member 8 takes the form of a slightly spherical membrane 11 (FIG. 3). Owing to its spherical nature, membrane 11 is in fact over-dimensioned, whereby a good deformability of membrane 11 is achieved. Because in the shown embodiment the membrane 11 is moreover placed eccentrically relative to engaging means 3 and holding means 15, a maximum pivoting movement is possible in a determined preferred direction. Pins 19 are similar to pins 9 (FIG. 1A), but may be shorter to engage the neck 7 of the ampule 2.

Conversely, a centered membrane in the form of a concertina-like or step-like coupling sleeve could of course also be applied between the two sleeves 3, 5. Although the breaking movement could hereby be performed in any random direction, this movement would as such be more limited and therefore perhaps less effective.

Figure 2B:
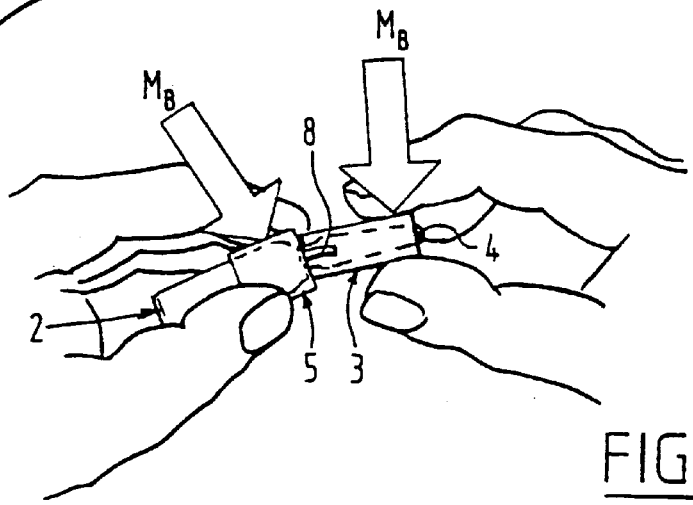

The operation of clamping device 1 is now as follows: An ampule 2 is pressed with its head 4 into engaging means 3 until the neck 7 of ampule 3 has reached the position at the outer end 10 of sleeve 3 (FIG. 2A). Reaching of this position is easy to see, particularly when clamping device 1 is manufactured from a translucent or transparent material, but can also be felt in an increase of the resistance during pressing in. Head 4 is herein held fast by inward protruding pins 9 or ribs 13. The body 6 of ampule 2 is then accommodated in the lower sleeve or holding means 5. By now gripping a sleeve 3, 5 with each hand and then bending the two sleeves 3, 5 relative to one another round a bend line B defined by hinge members 8, a bending moment $M_B$ is exerted on ampule 2 which eventually results in collapse of neck 7 thereof (FIG. 2B).

Figure 2C:
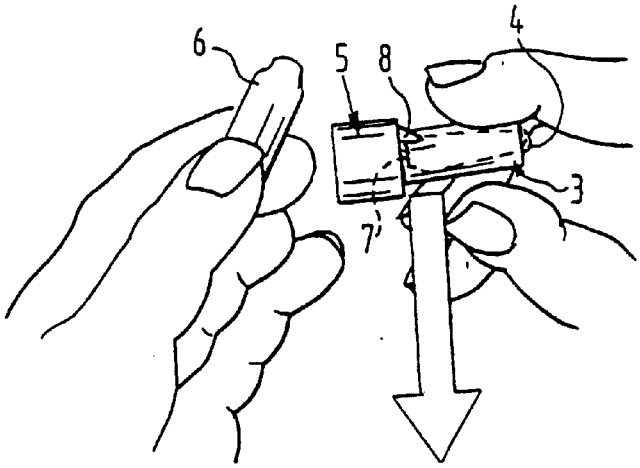
Figure 2D:
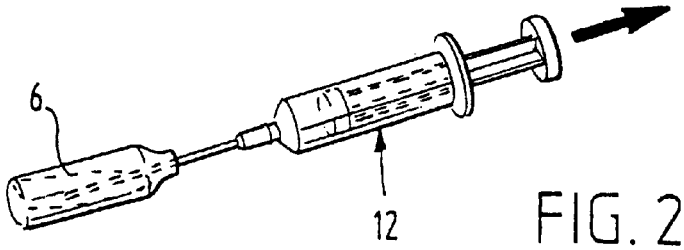

After collapse of neck 7, head 4 and body 6 of ampule 2 remain clamped in sleeves 3, 5, whereby the risk of injury to the user is minimized. Body 6 can then be taken out of lower sleeve 5 (FIG. 2C) and the content thereof can be used, for instance in a hypodermic syringe 12 (FIG. 2D). Clamping device 1 with head 4 of ampule 2 received therein can be thrown away (FIG. 2C). After being emptied, the body 6 of ampule 2 can optionally be re-placed in clamping device 1 and discarded therewith, whereby the broken edge thereof is protected.

Although the invention is described above with reference to a number of embodiments, it will be apparent to the skilled person that it is not limited thereto and that many adaptations and modifications are possible within the scope of the invention. The scope of the invention is therefore defined solely by the appended claims.

What is claimed is:

1. A device for clamping and breaking a breakable ampule, said device comprising a first sleeve for engaging the ampule on one side of a breaking point, and a second sleeve for holding a part of the ampule lying on the other side of the breaking point, with said second sleeve being movably connected to said first sleeve by at least one hinge member, with said second sleeve having an elliptic form and manufactured from a resiliently deformable material, so as to accommodate ampules having various dimensions, and wherein a continuous bore connects said first sleeve with said second sleeve to permit the device to simultaneously fit over both a head and a body of the ampule, wherein the elliptical form has the shape of an ellipse with two distinct and separate foci.

2. The device as claimed in claim 1, wherein the at least one hinge member is comprised of two relatively flat hinge members placed radially opposite each other and arranged between the first and second sleeves.

3. The device as claimed in claim 2, wherein said hinge members are placed in a longitudinal direction along the elliptic shape of said second sleeve and are flexible in transverse direction thereof.

4. The device as claimed in claim 1, wherein the at least one hinge member is comprised of a flexible membrane.

5. The device as claimed in claim 1, wherein the first and second sleeves and the at least one hinge member are formed integrally.

6. The device as claimed in claim 1, wherein said first sleeve is closed on a side remote from said second sleeve by a sleeve head.

7. The device as claimed in claim 1, wherein the clamping device is manufactured from a translucent material.

8. The device as claimed in claim 1, wherein the clamping device is manufactured from a transparent material.

* * * * *

UNITED STATES PATENT AND TRADEMARK OFFICE

CERTIFICATE OF CORRECTION

PATENT NO. : 6,540,125 B1 
APPLICATION NO. : 09/647039
DATED : April 1, 2003
INVENTOR(S) : Hemanus Hendrik De Jongh et al.

It is certified that error appears in the above-identified patent and that said Letters Patent is hereby corrected as shown below:

Delete Column 1 Lines 6-59 and insert the following:

--The invention relates to a device for clamping a breakable object, in particular an ampule, provided with a first sleeve for engaging the object on one side of a possible breaking point, and a second sleeve for holding a part of the object, lying on the other side of the breaking point, said second sleeve being movably connected to said first sleeve by at least one hinge member. Such a device is known from EP-A-0 440 354 and is used for breaking glass ampules without the risk of injury due to broken glass fragments.

Such a breaking ampule, which is generally manufactured from glass, consists of a body in which liquid is arranged and a head connected thereto via a narrowed neck. The narrowed neck herein forms the intended breaking point of the ampule. The known ampule breaker consists of a two-part tubular plastic member, which is open on one side. The tubular member comprises a substantially cylindrical body and a smaller diameter head connected to the body by means of an integral or live hinge. The diameter of the body is adapted to the diameter of the ampule to be broken, whereas the diameter of the head of the tubular member is somewhat greater than that of the head of the ampule, but is reduced by a number of ribs projecting from the inner wall of the head.

As a result of the presence of the resilient ribs, the neck and the head of the ampule are clamped into the upper part of the tubular member, whereafter the upper and lower part of the tubular member can be gripped and can be pivoted relative to each other by virtue of the live hinge therebetween until the neck breaks, whereby the ampule is opened. Because the neck, head and body of the ampule are wholly enclosed by the tubular member during breaking thereof, they have excellent protection. A relatively great force can thus be exerted thereon without the risk of the head in particular being squeezed into pieces and the user being injured by glass splinters. The broken-off head and body are moreover held in the tubular member, so that they can be easily discarded without forming a hazard in the waste flow.

The known device has the drawback that it is only adapted for accommodating one specific size of ampule. This is because the body of the ampule breaker is cylindrical and has an inner diameter that is adapted to the outer diameter of one specific size of ampule. Therefore, different ampule breakers have to be stocked for use with different sizes of ampules containing different volumes of liquid.

UNITED STATES PATENT AND TRADEMARK OFFICE

CERTIFICATE OF CORRECTION

PATENT NO. : 6,540,125 B1
APPLICATION NO. : 09/647039
DATED : April 1, 2003
INVENTOR(S) : Hermanus Hendrik De Jongh et al.

It is certified that error appears in the above-identified patent and that said Letters Patent is hereby corrected as shown below:

SUMMARY OF THE INVENTION

The invention now has for its object to improve an ampule breaker of the above described type such that the above stated drawback does not occur. This is achieved according to the invention in that said second sleeve has an elliptic form and is manufactured from a resiliently deformable material, so as to accommodate objects having various dimensions.--.

Signed and Sealed this

Tenth Day of October, 2006

JON W. DUDAS
*Director of the United States Patent and Trademark Office*